United States Patent [19]

Ichikawa

[11] 4,270,193

[45] * May 26, 1981

[54] ELECTRONIC TIMEPIECE

[75] Inventor: Singo Ichikawa, Sayama, Japan

[73] Assignee: Citizen Watch Company Limited, Tokyo, Japan

[ * ] Notice: The portion of the term of this patent subsequent to Apr. 3, 1996, has been disclaimed.

[21] Appl. No.: 28,012

[22] Filed: Apr. 2, 1979

Related U.S. Application Data

[62] Division of Ser. No. 726,014, Sep. 22, 1976, Pat. No. 4,147,022.

[30] Foreign Application Priority Data

Dec. 24, 1975 [JP] Japan ..... 50-154318

[51] Int. Cl.[3] ..... G04C 11/02

[52] U.S. Cl. ..... 368/47; 368/184; 368/187; 368/200; 368/201

[58] Field of Search ..... 368/47, 184, 187, 200, 368/201, 202

[56] References Cited

U.S. PATENT DOCUMENTS

| | | | |
|---|---|---|---|
| 4,023,344 | 5/1977 | Mukaiyama | 368/187 X |
| 4,051,663 | 10/1977 | Chihara et al. | 368/200 |
| 4,147,022 | 4/1979 | Ichikawa | 58/85.5 X |
| 4,187,518 | 2/1980 | Martin et al. | 368/82 X |
| 4,211,065 | 7/1980 | Schmitz et al. | 368/1 |

*Primary Examiner*—Ulysses Weldon

*Attorney, Agent, or Firm*—Jordan and Hamburg

[57] ABSTRACT

An electronic timepiece adapted to perform time correction in response to a train of time correction pulses transmitted from another electronic timepiece. The electronic timepiece comprises a detecting means to detect the train of time correction pulses; a writing-in signal generator circuit to generate writing-in signals in synchronism with a synchronizing signal contained in the train of time correction pulses, and a writing-in gate circuit means to perform writing-in of the train of time correction pulses into a timekeeping circuit of the timepiece as new current time data in response to the writing-in signals.

4 Claims, 8 Drawing Figures

TIMEKEEPING CIRCUIT
30
31
MONTHS MEMORY COUNTER 44
DAYS OF WEEK MEMORY COUNTER 42
DATES MEMORY COUNTER 40
AM/PM MEMORY COUNTER 38
HOURS MEMORY COUNTER 36
MINUTES MEMORY COUNTER 34
SECOND MEMORY COUNTER 32
DISPLAY DEVICE
DRIVER CIRCUIT
FREQUENCY STANDARD
FREQUENCY CONVERTER
DIFFERENTIATING CIRCUIT 70
"0"
"1"
Po
Ps
Tn
Ti
Tnt4
R
S
T
Q

DISPLAY DEVICE
102
DRIVER CIRCUIT
100
122
R
Q
S
$\overline{Q}_1$
84
SECOND SHIFT REGISTER 94
a b c d
HALF ADDER 104
90
DELAY CIRCUIT 106
110
112
$\Phi_0 T_1 t_1$
108
$\overline{Q}_1$
CARRY OUT CONTROL CIRCUIT 86
98
88
FIRST SHIFT REGISTER
92
118
96
116
$P_1$
114
136
132
$Q_1$ $\overline{Q}_1$
$S_1$ $R_1$
120
128a
Tnt4
128
126a
126b
DIFFERENTIATING CIRCUIT 138
FREQUENCY STANDARD 80
Tn
T'
CL
R
82
$\Phi$
134
$S_2$
$Q_2$
$R_2$
130
130a
129
$P_1$
"0"
"1"
126
140
"0"

31
30
29
DISPLAY DEVICE
27
DRIVER CIRCUIT
26
FREQUENCY STANDARD
28
FREQUENCY CONVERTER
TIMEKEEPING CIRCUIT
YEARS MEMORY COUNTER 45
DAYS OF WEEK MEMORY COUNTER 42
MONTHS MEMORY COUNTER 44
DATES MEMORY COUNTER 40
AM/PM MEMORY COUNTER 38
HOURS MEMORY COUNTER 36
MINUTES MEMORY COUNTER 34
SECONDS MEMORY COUNTER 32
46
72
24
"1"
DIFFERENTIATING CIRCUIT 70
70a
74
66
60
62
64
68
R S Q
R Q̄ S
Tr Ps R
Tn
Ti
Tnt4
Po
Pt
φ

ELECTRONIC TIMEPIECE

This is a division of Ser. No. 726,014 filed Sept. 22, 1976 now U.S. Pat. No. 4,147,022.

This invention relates, in general, electronic timepieces and, more particularly, to a method and device for performing time correction of such electronic timepieces.

In conventional electronic timepieces, it has been a common practice to provide several external control switches to achieve time correction. In this prior art practice, it is required that the control switches be operated a number of times in a complicated manner. Another problem is encountered in the prior art method in that there exists a time difference between the actual operation of the switches and the standard time to which the current time data in the electronic timepiece are to be corrected and, thus, it is extremely difficult to precisely perform time correction in a reliable manner.

It is, therefore, an object of the present invention to provide a method for instantaneously performing time correction in an electronic timepiece in a highly reliable manner without complicated operations of external switches.

It is another object of the present invention to provide an electronic timepiece capable of instantaneously performing time correction in a highly reliable manner.

It is another object of the present invention to provide an electronic timepiece arranged to receive correct time data from another electronic timepiece.

It is still another object of the present invention to provide an electronic timepiece in which time correction can be easily performed merely by placing this timepiece onto another electronic timepiece adapted to transmit time data.

It is a further object of the present invention to provide an electronic timepiece incorporating a simple circuit arrangement adapted to perform writing-in of correct time data transferred from another electronic timepiece.

These and other objects, features and advantages of the present invention will become more apparent from the following description when taken in conjunction with the accompanying drawings, in which.

Figure 1:
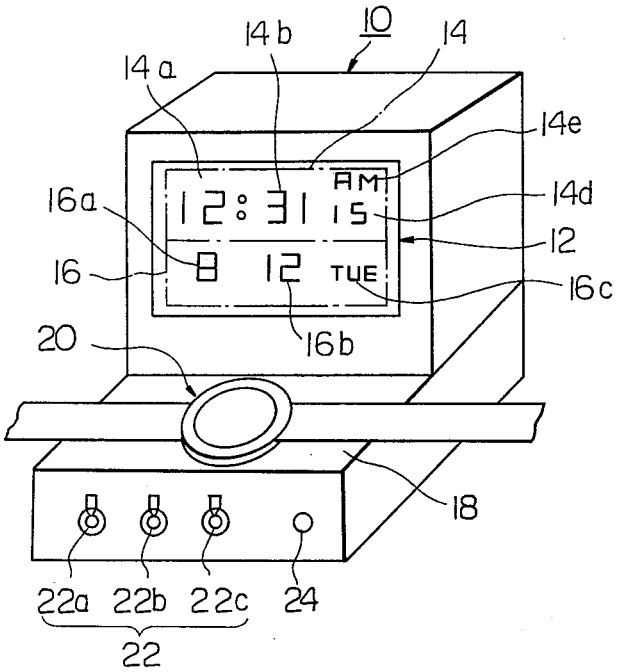
FIG. 1 is a perspective view of first and second electronic timepieces to carry out a method of the present invention.

Referring now to FIG. 1, there is schematically shown a preferred embodiment of a first electronic timepiece serving as a time correction device adapted for automatically correcting current time data in a second electronic timepiece according to the present invention. The first electronic timepiece, generally designated as 10, has a display section 12. The display section 12 comprises a current time display section 14 and a function display section 16. The current time display section contains an hours display station 14*a*, a minutes display station 14*b*, a seconds display station 14*d*, and an AM/PM indicating symbol 14*d*. The function display station 16 contains a months display station 16*a*, a days display station 16*b*, and a days of week display station 16*c*. The first electronic timepiece 10 also has a setting table 18 on which a second electronic timepiece 20 is placed for time correction. A signal selector means 22 composed of digit selector switches 22*a*, 22*b* and 22*c* is operatively mounted on front face of the table 18, on which a correction switch 24 is operatively mounted.

Figure 2:
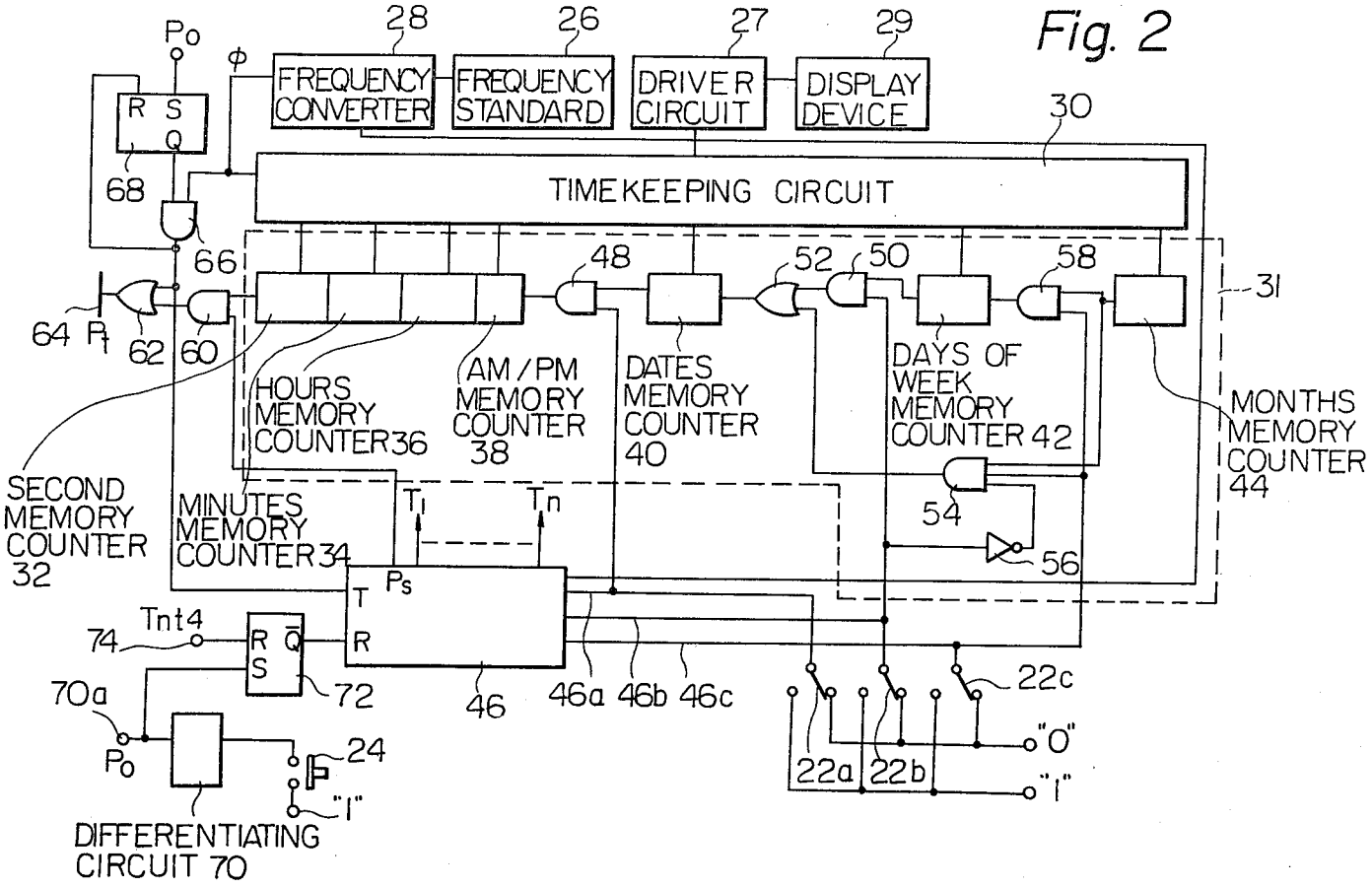
FIG. 2 is a block diagram of a preferred embodiment of the first electronic timepiece shown in FIG. 1.

As shown in FIG. 2, the electronic timepiece 10 serving as the time correction device comprises a frequency standard 26 composed of a quartz crystal controlled oscillator circuit, preferably operating at a frequency of 32,768 Hz. This relatively high frequency signal is applied to a frequency converter 28 in the form of a frequency divider, which divides down the relatively high frequency signal to produce a train of clock pulses $\phi$ having a period of one second. The clock pulses $\phi$ from frequency converter 28 is applied to a timekeeping circuit 30. The timekeeping circuit 30 comprises a second counter, a minutes counter, an hours counter, an AM/PM counter, a dates counter, a days of week counter and a months counter. The timekeeping circuit 30 is coupled to a driver circuit 27 to drive a display device 29 for the display of the contents of the timekeeping circuit 30. A read-out circuit 31 comprises a plurality of memory counters 32, 34, 36, 38, 40, 42 and 44 which are connected in parallel with the seconds counter, minutes counter, hours counter, AM/PM counter, dates counter, dates counter, days of week counter and months counter, respectively, and which are also connected in series with one another to provide a train of read-out pulses. Each of the memory counters comprises a shift register and stores the content of the corresponding counter in response to the clock pulses $\phi$ from the frequency converter 28. Namely, the memory counters 32, 34, 36, 38, 40, 42 and 44 store seconds data, minutes data, hours data, AM/PM data, dates data, days of week data and month data, respectively, in four bits as current time data.

In FIG. 2, the first electronic timepiece 10 also comprises a read-out control signal generator circuit 46 having input terminals 46*a*, 46*b* and 46*c* coupled to the digit selector switches 22*a*, 22*b* and 22*c* which are normally held in a low logic state, i.e., a binary "0" state in FIG. 2. Application of input pulses to input terminals 46*a*, 46*b* and 46*c* from the selector switches 22*a*, 22*b* and 22*c* causes digit signals Tl to Tn and a train of sampling pulses Ps to appear on output terminals of the read-out control signal generator circuit 46. The digit signals Tl to Tn are applied as read-out control signals to the shift registers 32, 34, 36, 38, 40, 42 and 44, respectively, to perform shifting operation. More specifically, if all of the digit selector switches 22*a*, 22*b* and 22*c* remain in the OFF state as shown in FIG. 2, only the seconds memory counter 32, minutes memory counter 34, hours memory counter 36 and AM/PM memory counter 38 are selected. In this case, the signal generator circuit 46 generates digit signals T1 to T6 of which digit signals T1 and T2 are applied to the seconds memory counter 32, digit signals T3 and T4 to the minutes memory counter 34, digit signal T5 to the hours memory counter 36, and digit signal T6 to the AM/PM memory counter 38. If all of the digit selector switches 22*a*, 22*b* and 22*c* are turned on, all of the memory counters 32, 34, 36, 38, 40, 42 and 44 are selected. In this case, the signal generator circuit 46 generates digit signals T1 to T10, of which digit signals T7 and T8 are applied to the dates memory counter 40, digit signal T9 to the days of week memory counter 42, and digit signal T10 to the months memory counter 44. The sampling pulses Ps are generated by the signal generator circuit 46 in synchronism with the rising edge of each of bit signals t1 to t4 constituting the digit signals T.

As shown in FIG. 2, the digit selector switch 22*a* is also coupled to one input of an AND gate 48 whose another input is coupled to an output of the dates memory counter 40. An output of the AND gate 48 is coupled to an input of the AM/PM memory counter 38. Similarly, the digit selector switch 22*b* is also coupled to one input of an AND gate 50 whose another input is coupled to an output of the days of week memory counter 42. An output of the AND gate 50 is coupled to one input of an OR gate 52, whose another input is coupled to an output of an AND gate 54. The AND gate 54 has a first input coupled via inverter 56 to the digit selector switch 22, a second input coupled to the selector switch 22*c*, and a third input coupled to an output of the months memory counter 44, to which one input of an AND gate 58 is also coupled. The other input of the AND gate 58 is coupled to the selector switch 22*c* and an output thereof is coupled to the days of week memory counter 42.

The sampling pulses Ps are applied to one input of an AND gate 60 serving as a read-out control gate whose another input is coupled to an output of the read-out circuit 31. An output of the AND gate 60 is coupled to one input of an OR gate 62 having its output coupled to an electrode plate 64 serving as a data transmitting means which may be preferably disposed in the setting table 18 to transmit binary coded correction pulses Pt as current time data to the second electronic timepiece for time correction. The other input of the OR gate 62 is coupled to an output of an AND gate 66 to which a triggering terminal Tr of the signal generator circuit 46 is also coupled. The AND gate 66 has one input coupled to the output of the frequency converter 28 to which the timekeeping circuit 30 is also coupled, and another input coupled to the Q output of an R-S type flip-flop 68. The flip-flop 68 has a set terminal S coupled to an output terminal 70*a* of a differentiating circuit 70 to receive control pulses Po therefrom, and a reset terminal R coupled to the output of the AND gate 66. The differentiating circuit 70 is coupled at its input to the correction switch 24 which is normally held in its open condition and which generates control pulses Po in synchronism with actuating signals delivered from the correction switch 24 when it is depressed. The output of the differentiating circuit 70 is also coupled to a set terminal S of an R-S type flip-flop 72 whose reset terminal R is coupled to a terminal 74 to receive a final read-out control signal Tnt4. The $\overline{Q}$ output of the flip-flop 72 is coupled to a reset terminal of the signal generator circuit 46.

With the arrangement mentioned above, if all of the digit selector switches 22*a*, 22*b* and 22*c* remain in the open state, the AND gates 48, 50, 54 and 58 are inhibited and, therefore, the seconds memory counter 32, minutes memory counter 34, hours memory counter 36 and AM/PM memory counter 38 are selected. In this situation, the read-out signal generator circuit 46 generates digit signals T1 to T6 as read-out control signals and sampling pulses Ps corresponding to the digit signals T1 to T6.

When, now, only the digit selector switch 22*a* is closed, the AND gate 48 is opened, coupling the dates memory counter 40 to the AM/PM memory counter 38 in series. Thus, the actuation of the digit selector switch 22*a* causes the seconds memory counter 32, minutes memory counter 34, hours memory counter 36, AM/PM memory counter 38 and the dates memory counter 40 to be selected. In this condition, the signal generator circuit 46 generates digit signals T1 to T8 and sampling pulses corresponding to the digit signals T1 to T8.

When the digit selector switch 22*b* is closed while the digit selector switch 22*a* remains in its closed state, the AND gates 48 and 50 are opened, coupling the dates memory counter 40 and the days of week memory counter 42 to the AM/PM memory counter 38 in series. At the same time, the signal generator circuit 46 generates digit signals T1 to T9 and sampling pulses Ps corresponding to the digit signals T1 to T9.

When the digit selector switch 22*c* is closed while the digit selector switch 22*a* remains in its closed state, the AND gates 48, 54 and 58 are opened, coupling the dates memory counter 40 and the months counter 44 to the AM/PM memory counter 38 in series. Likewise, when all of the digit selector switches 22*a*, 22*b* and 22*c* are closed, all of the memory counters are selected as previously described above.

It will thus be seen that the digit selector switches 22*a*, 22*b* and 22*c* are used for selecting digits, i.e., dates, days of week and months, to be corrected to permit correction of calendar data in the second electronic timepiece 20 (see FIG. 1) in addition to the correction of basic current time data.

Figure 4:
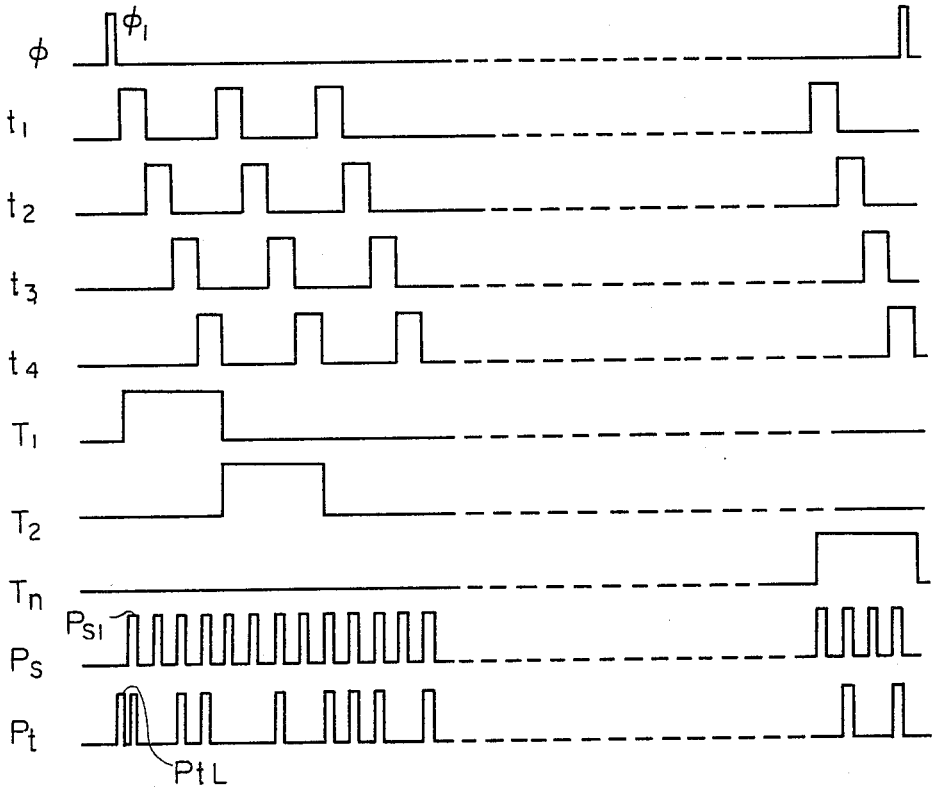
FIG. 4 is a timing chart for illustrating the operations of the first and second electronic timepieces shown in FIGS. 2 and 3.

A method in which the binary coded correction pulses Pt shown in FIG. 4 are generated as current time data will now be described with reference to FIG. 2. In FIG. 2, the flip-flops 68 and 72 are normally held in their reset condition. In this condition, the Q output of the flip-flop 68 is at a low logic level, inhibiting the AND gate 66. At the same time, the read-out control signal generator circuit 46 is reset in response to the $\overline{Q}$ output of the flip-flop 72. Under these circumstances, time correction pulses Pt do not appear at the electrode plate 64.

When, now, the correction switch 24 is actuated, control pulses Po are delivered to the terminal 70*a* from the differentiating circuit 70. The control pulses Po are applied to the flip-flops 68 and 72 so that these flip-flops are set. Therefore, the Q output of the flip-flop 68 goes to a high logic level, opening the AND gate 66. At the same time, the $\overline{Q}$ output of the flip-flop 72 goes to a low logic level so that reset condition of the signal generator circuit 46 is released. A first clock pulse $\phi$1 appearing after the correction switch 24 has been actuated causes the counts in the timekeeping circuit 30 to advance by one step to update the current time data stored therein in synchronism with the falling edge of the clock pulse signal $\phi$1. The updated data are applied to the memory counters 32, 34, 36, 38, 40, 42 and 44 in parallel and stored therein. At the same time, the clock pulse signal $\phi$1 is applied through the AND gate 66 to the triggering terminal Tr of the read-out control signal generator circuit 46 to trigger the same and also applied through the OR gate 62 to the electrode plate 64. Under these circumstances, the signal generator circuit 46 generates digit signals T as read-out control signals and sampling pulses Ps in response to a selected combination of operations of the digit selector switches 22*a*, 22*b* and 22*c*, so that the contents in the memory counters are shifted leftward as viewed in FIG. 2.

As a result, the current time data stored in a first stage of the seconds memory counter 32 are read out by the AND gate 60 in response to a first pulse of the train of sampling pulses Ps. If, in this instance, the content in the first stage of the seconds memory counter 32 is at a binary "1" level, then the first pulse Ps1 of the train of sampling pulses Ps are delivered as time correction pulse Pt to the electrode plate 64 through the AND gate 60 and OR gate 62. In this manner, the data stored in each memory counter are shifted leftward in response to the falling edges of the bit signals t1 to t4 and read out in response to the sampling pulses Ps. The signal generator circuit 46 is reset by the $\overline{Q}$ output of the flip-flop 72 in response to a prescribed read-out control signal Tnt4 and, thus, completes a first time correcting operation. During time correcting operation, the electrode plate 64 is applied with a train of correction pulses Pt having the waveform as shown in FIG. 4 corresponding to the current time data stored in the memory counters, with the first pulse Pt1 corresponding to the clock pulse $\phi$1 from the frequency converter 28. Since the clock pulse $\phi$1 is also applied to the reset terminal of the flip-flop 68, the flip-flop 68 is reset and a subsequent clock pulses $\phi$ are inhibited by the AND gate 66. Thus, the clock pulses $\phi$ are applied only to the timekeeping circuit 30 for updating the current time data stored therein. It should be noted that the first pulse Pt1 appearing in the train of read-out signals Pt is utilized as a synchronizing pulse to obtain synchronization in operation between the first and second electronic timepieces as will be subsequently described in detail.

Figure 3:
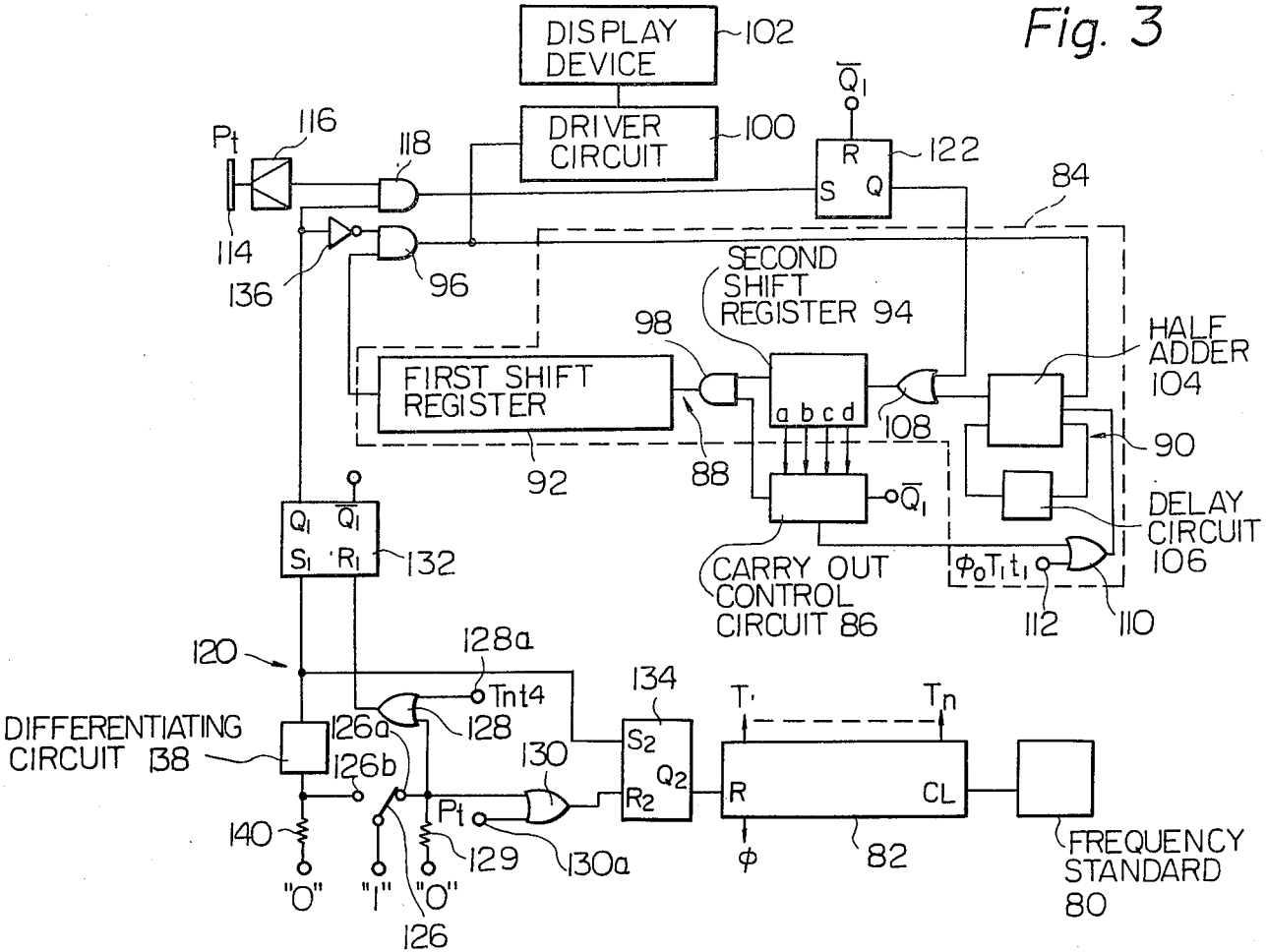
FIG. 3 is a block diagram of a preferred embodiment of the second electronic timepiece shown in FIG. 1.

FIG. 3 shows a preferred embodiment of the second electronic timepiece 20 shown in FIG. 1. As shown, the second electronic timepiece 20 comprises a frequency standard 80, preferably controlled by a quartz crystal, to provide a relatively high frequency signal of, for example, 32,768 Hz. This relatively high frequency signal is applied to a clock terminal CL of a frequency converter 82 which generates digit signals T1 to Tn, bit signals t1 to t4, and a train of clock pulses $\phi$ having a period of one second as shown in FIG. 4. The second electronic timepiece 20 also comprises a timekeeping circuit 84 and a carry out control circuit 86. The timekeeping circuit 84 is basically a storage register into which data can be serially added. The timekeeping circuit 84 includes a shift register ring 88 and a serial adder circuit 90.

The shift register ring 88 includes a first shift register 92, the output thereof being coupled to a four-bit shift register 94 via an AND gate 96 and the serial adder circuit 90. The output from shift register 94 is coupled to one input of an AND gate 98, whose another input is coupled to the carry out control circuit 86 to receive an erasure signal therefrom when a carry is caused into the next data. An output of the AND gate 98 is coupled to an input of the first shift register 92, constituting a ring configuration. The output from the first shift register 92 is transferred through the AND gate 96 to a driver circuit 100 which drives a display device 102. The display device 102 can be of liquid crystal type or electrochromic display type, etc.

As shown in FIG. 3, the serial adder circuit 90 is included in the shift register ring 88 so that data stored therein may be incremented. The serial adder circuit 90 comprises a half-adder 104, a bistable delay circuit 106, a first OR gate 108 serving as a writing-in gate and a second OR gate 110. The OR gate 110 has one input 112 to which the clock pulses $\phi$ having the period of one second is applied in synchronism with the timing signal T1t1. The other input of the OR gate 110 is also coupled to the output of the carry out control circuit 86 to receive a carry out signal therefrom. Thus, a time unit input $\phi$ T1t1 is applied to the serial adder circuit 90 so that data stored in the shift register ring 88 may be incremented to continuously update the current time data stored therein.

The arrangements for performing the carry function between the different time units used in the timepiece are dictated by the maximum values of the "units" and "tens" digit words corresponding to minutes, hours, etc. For the seconds and minutes, the "units" digits of the corresponding data are in the range 0 to 9, and the "tens" digits from 0 to 6. For hours and months, the "units" digit ranges from 1 to 2, for days of the week there is only a "units" digit, from 1 to 7. Means must therefore be provided for detecting when a word carry or digit carry is necessary, dependent on these "units" and "tens" values, i.e., after the "tens" of the minutes data reaches 6, a word carry must be generated to increment the hours data, when the next minutes data increment occurs. To this end, the data from outputs a, b, c and d of the second shift register 94 are monitored in the carry out control circuit 86 by which carry out signals are generated in dependence on the contents of these outputs. As already noted hereinabove, each of the carry out signals is applied through the OR gate 110 to the adder 104 in synchronism with the timing T1t1 and delayed by one bit time by the delay circuit 106 whereupon it is again applied to the adder 104 to cause a carry in the stored data. In this manner, the current time data stored in the timekeeping circuit 84 is continuously updated.

In accordance with an essential feature of the present invention, correction of current time data stored in the second electronic timepiece 20 can be instantaneously performed in an automatic fashion merely by suitably placing the timepiece 20 onto the setting table 18 as shown in FIG. 1. This is because of the fact that the second electronic timepiece 20 is adapted to receive time data from the first electronic timepiece 10 whereby the correction pulses Pt are input as correct current time data to the shift register ring 88 of the timepiece 20 via the writing-in gate 108 forming part of a correction circuit means 113.

To this end, the correction circuit means 113 further comprises an electrode plate 114 serving as a detecting means for detecting the time data, i.e., the correction pulses Pt transferred from the first electronic timepiece 10. The electrode plate 114 may be preferably incorporated within a watch case in such a suitable place as to readily detect the correction pulses Pt when the second timepiece 20 is placed on the setting table of the first timepiece 10. The correction pulses Pt thus detected are applied through a waveform shaping circuit 116 to one input of an AND gate 118 serving as a control gate. The waveform shaping circuit 116 may be composed of a plurality of stages of CMOS inverters to perform waveform shaping and amplification of the correction pulses Pt to provide output signals indicative of the time data from the timepiece 10. The other input of the control gate 118 is coupled to a switching device 120 to receive a control signal therefrom. The control gate has an output coupled to a set terminal of a one-bit shift register 122, which serves as a storing means for temporarily storing the correction pulses Pt and transferring these pulses to the shift register ring 88 via the writing-in gate 108 in synchronism with the bit signals t1 through t4.

The switching device 120 comprises a correction switch 126, which is normally connected to a first or non-correction terminal 126*a* to apply a binary "1" signal to inputs of OR gates 128 and 130 to which a binary "0" signal input terminal is connected via a biasing resistor 129. The other input of the OR gate 128 is coupled to a terminal 128*a* to receive a final timing signal Tnt4 from the frequency converter 82. The other input of the OR gate 130 is coupled to a terminal 130*a* to receive the correction pulses Pt from the electrode plate 114. Outputs of the OR gates 128 and 130 are coupled to reset terminals $R_1$ and $R_2$ of R-S type flip-flops 132 and 134, respectively. The flip-flop 132 has its $Q_1$ output coupled to the other input of the AND gate 118 and coupled via an inverter 136 to the other input of the AND gate 96. The $\overline{Q_1}$ output of the flip-flop 132 is coupled to the reset terminal R of the shift register 122 and to the set terminal S of the carry out control circuit 86. The set terminal of the flip-flop 132 is coupled to an output of a differentiating circuit 138 to which a set terminal of the flip-flop 134 is also coupled. The differentiating circuit 138 is coupled at its input to a second or correction terminal 126*b* and a binary "0" signal input terminal via a biasing resistor 140. The $Q_2$ output of the flip-flop 134 is coupled to a reset terminal of the frequency converter 82.

A method in which time correction is performed will now be described with reference to FIGS. 1, 2, 3 and 4.

In the second electronic timepiece 20, the correction switch 126 is normally connected to the first or non-correction terminal 126*a* and a binary "0" signal is applied to the reset terminals of the flip-flops 132 and 134, which are consequently reset. In this condition, the frequency converter 82 is not in a reset condition so that it generates various timing signals and clock pulses which are applied to various parts of the timekeeping circuit 84. Since, in this instance, the $Q_1$ output of the flip-flop 132 is at a low logic level, the control gate 118 is inhibited whereas the AND gate is opened. Since, further, the $\overline{Q_1}$ output of the flip-flop 132 is at a high logic level, the shift register 122 remains in its reset condition whereas the carry out control circuit 86 remains in its operative condition. Thus, the current time data is shifted cyclically in the shift register ring 88 while being updated in response to the timing signals delivered from the frequency converter 82. The output from the first shift register 92 is passed through the AND gate 96 to the driver 100 which drives the display device 102 to display the current time data stored in the shift register ring 88.

When, now the correction switch 126 is brought into engagement with the second or correction terminal 126*b*, the differentiating circuit 138 generates a differentiation pulse, which is applied to the set terminals of the flip-flops 132 and 134. Consequently, the $Q_1$ output of the flip-flop 132 goes to a high level, opening the control gate 118 while inhibiting the AND gate 96. Since, on the other hand, the $\overline{Q_1}$ output of the flip-flop 132 goes to a low logic level, the reset condition of the shift register 122 is released and the carry out control circuit 86 is rendered inoperative. At the same time, the $Q_2$ output of the flip-flop 134 goes to a high logic level, resetting the frequency converter 82 so that the timing signals and clock pulses are not generated. It will thus be understood that when the correction switch 126 is connected to the correction terminal 126*b* normal timekeeping operation of the shift register ring 88 is inhibited and, instead thereof, a new time correction loop is constituted by the electrode plate 114, waveform shaping circuit 116, control gate 118, shift register 122, OR gate 108, second shift register 94, AND gate 98 and first shift register 92 while the carry out control circuit 86 is rendered inoperative. In this condition, the second electronic timepiece 20 is placed on the setting table 18 of the first electronic timepiece 10 as shown in FIG. 1. Subsequently, a selected one of or selected combination of the digit selector switches 22*a*, 22*b* and 22*c* are actuated to bring data to be transferred from electrode plate 64 into conformity with data to be written in the shift register ring 88 of the second electronic timepiece 20, whereupon the correction switch 24 of the timepiece 10 is actuated. Application of a binary "1" signal to the input of the differentiating circuit 70 of the first electronic timepiece 10 causes a control pulse Po to appear at the output terminal 70*a*. This control pulse Po is applied to the set terminal of the flip-flop 68 so that the Q output goes to a high logic level. Accordingly, the AND gate 66 is opened and a first clock pulse $\phi$1 of the train of clock pulses $\phi$ from the frequency converter 28 is gated through the AND gate 66 and the OR gate 62 to the electrode plate 64. Since the clock pulse $\phi_1$ is also applied to the reset terminal of the flip-flop 68, it is reset so that the Q output goes to the low logic level to inhibit the AND gate 66. In this manner, only the first clock pulse $\phi_1$ is gated through the AND gate 66 as a first pulse Pt1 of the train of the time correction pulses Pt having the waveform as shown in FIG. 4. The train of pulses Pt appearing at the electrode plate 64 is detected as correct time data by the electrode plate 114 of the second electronic timepiece 20 placed on the setting table 18 of the first electronic timepiece 10 (see FIG. 1). Waveform shaping of the time correction pulses Pt is then performed by the waveform shaping circuit 116. The first pulse Pt1 of the time correction pulses Pt is applied as a synchronizing signal through the terminal 130*a* to the OR gate 130 of the switching device 120, by which the flip-flop 134 is reset. Thus, the Q2 output goes to a low logic level, releasing the reset condition of the frequency converter 82. Therefore, the frequency divider 82 begins to generate digit signals T1 through Tn, bit signals and clock pulses $\phi$ in synchronism with the first input pulse Pti of the train of time correction pulses Pt. These signals are utilized as writing-in control signals to perform writing-in of correction pulses pt into the timekeeping circuit 84. On the other hand, the following pulses of the train of the time correction pulses Pt are sequentially applied through the control gate 118 to the one-bit shift register 122 and temporarily stored therein. The stored data is then read out in synchronism with the falling edge of each of the bit signals t1 through t4 generated by the frequency converter 82 and written into the shift register ring 88 via the writing-in gate 108 in a sequential fashion. The time correction pulses Pt are thus shifted leftward in the second shift register 94 and the first shift register 92 until the writing-in of the time correction pulses (i.e., the current time data of the first electronic timepiece 10) is completed in synchronism with a final writing-in control signal Tnt4 generated by the frequency converter 82. At this instant, since the flip-flop 132 is reset in response to the signal Tnt4 applied through the OR gate 128, the $Q_1$ output of the flip-flop 132 goes to a low logic level while the $\overline{Q}_1$ output goes to a high logic level. The AND gate 118 is therefore inhibited and the AND gate 96 is opened, to cause the shift register ring 88 to starts its normal timekeeping function. Since, at the same time, the carry output control circuit 86 is rendered operative in response to the $\overline{Q}_1$ output of the flip-flop 132, carry function will be performed while the new current time data is continuously shifted in the shift register ring 88. Thereafter, the correction switch 126 of the second electronic timepiece 20 is coupled to the non-correction terminal 126*a* to apply a binary "1" signal to the reset terminal of the flip-flop 134 via the OR gate 130, thereby locking the flip-flop 134 in its reset condition. Thus, erroneous operation of the flip-flop 134 due to noise pulses will be satisfactorily prevented.

Figure 5:
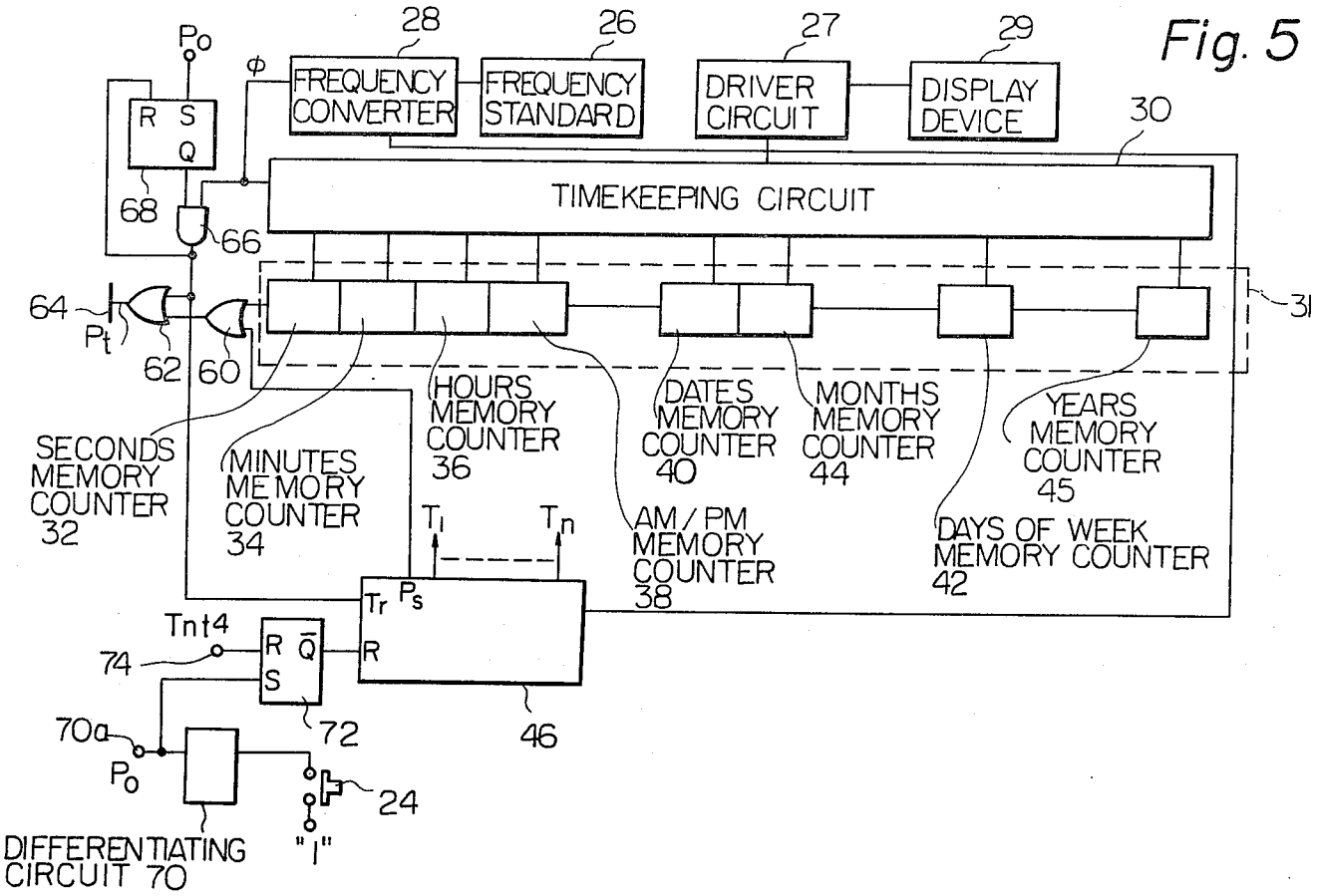
FIG. 5 is a block diagram of a modification of the first electronic timepiece shown in FIG. 1.

While, in the illustrated embodiment of FIG. 2, the first electronic timepiece 10 has been shown and described as having control gates 48, 52, 50, 54 and 58 and inverter 56 adapted to be controlled by selector switches 22*a*, 22*b* and 22*c*, it should be noted that these components may be dispensed with as shown in a modification of an electronic timepiece in FIG. 5 in which like or corresponding components are designated by the same reference numerals as those used in FIG. 2. In this modification, a seconds memory counter 32, a minutes memory counter 34, an hours memory counter 36, an AM/PM memory counter 38, a dates memory counter 40, a months memory counter 44, a days of week memory counter 42, and a years memory counter 45 are connected in series with one another in a predetermined order. In this case, the timekeeping circuit of the second electronic timepiece is arranged such that the current time data, i.e., seconds, minutes, hours, AM/PM symbols, dates, months, days of week and years are stored in the predetermined order. In a case where the second electronic timepiece merely has time information, the arrangement may be such that the seconds, minutes, hours and AM/PM symbols are stored in the timekeeping circuit in the same sequence as that of the current time data being output from the first electronic timepiece. With this arrangement, if the second electronic timepiece is placed on the setting table of the first electronic timepiece and time correction is initiated, only the current time data containing seconds, minutes, hours and AM/PM symbols stored in the first electronic timepiece are input to the timekeeping circuit of the first electronic timepiece and remaining data including dates, months, days of week and years are not input to the first electronic timepiece. This is because of the fact that a timing signal Tnt4 is generated by the frequency divider of the second electronic timepiece and applied to the terminal 128*a* of the OR gate 128 to reset the flip-flop 132 whereupon the control gate 118 is automatically inhibited when such a final information as AM/PM symbol is input to the shift register ring 88 of the second electronic timepiece. It will thus be seen that in cases where the current time data are stored in both of the first and second electronic timepieces in the same predetermined order, the selector switches and control gates associated therewith may be dispensed with as previously described.

Figure 6:
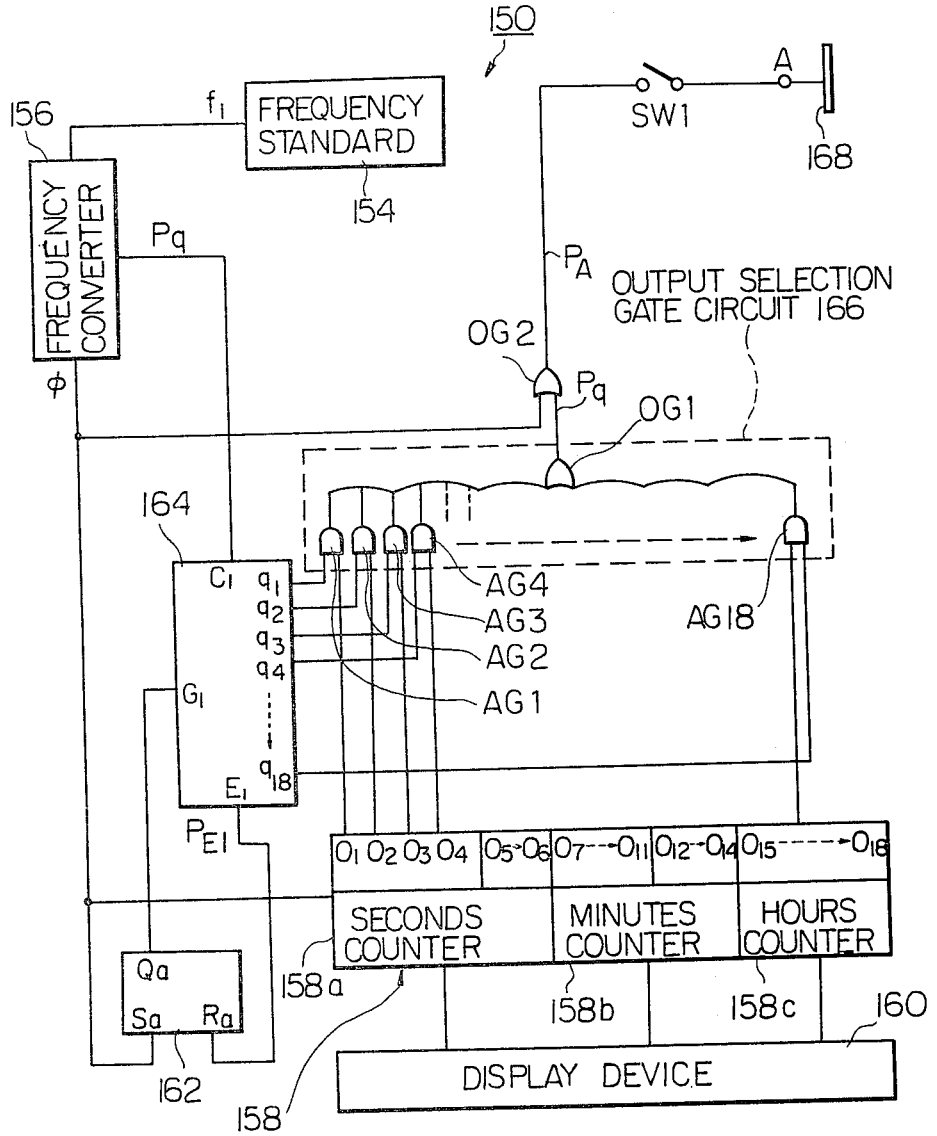
FIG. 6 is a block diagram of another preferred embodiment of the first electronic timepiece.
Figure 7:
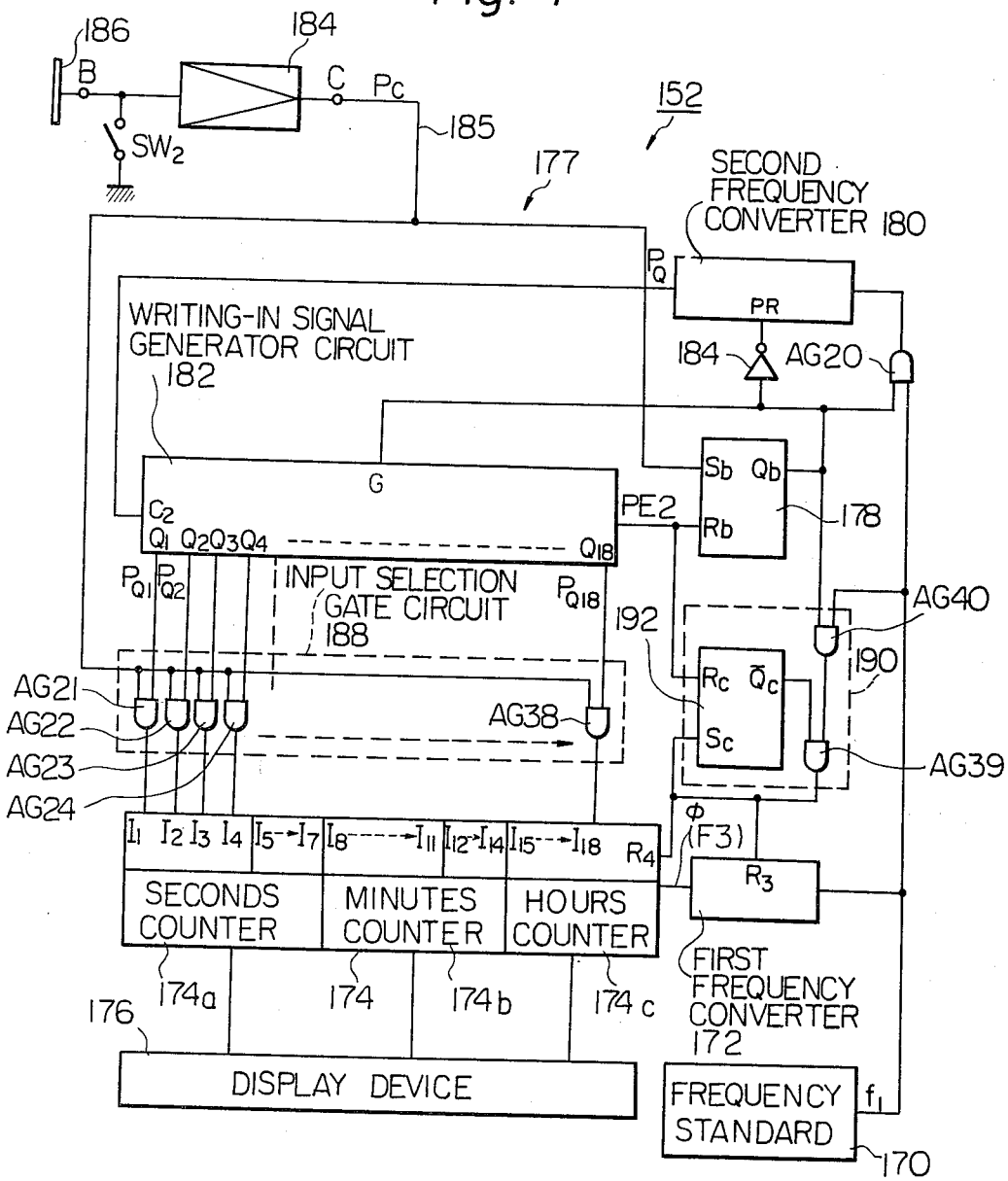
FIG. 7 is a block diagram of another preferred embodiment of the second electronic timepiece adapted to be associated with the first electronic timepiece shown in FIG. 6.

Another preferred embodiment of the present invention is illustrated in FIGS. 6 and 7 in which reference numeral 150 indicates a first electronic timepiece serving as a time correction device and 152 a second electronic timepiece whose current time is to be corrected.

Referring to FIG. 6, the first electronic timepiece 150 comprises a frequency standard, preferably controlled by a quartz crystal oscillator, to provide a relatively high frequency signal f1 of, for example, 32,768 Hz. This relatively high frequency signal f1 is applied to a frequency converter 156 in the form of a frequency divider which provides a train of read-out control pulses Pq at a frequency of, for example, 128 Hz and a train of clock pulses $\phi$ at a frequency of 1 Hz which serve as synchronizing pulses. The clock pulses $\phi$ are applied to a timekeeping circuit 158 by which the clock pulses are counted to provide various time data. In FIG. 6, the timekeeping circuit 158 is shown as comprising a seconds counter 158*a*, a minutes counter 158*b* and an hours counter 158*c*. Outputs from these counters are applied to a display device 160 for display of time information.

Figure 8:
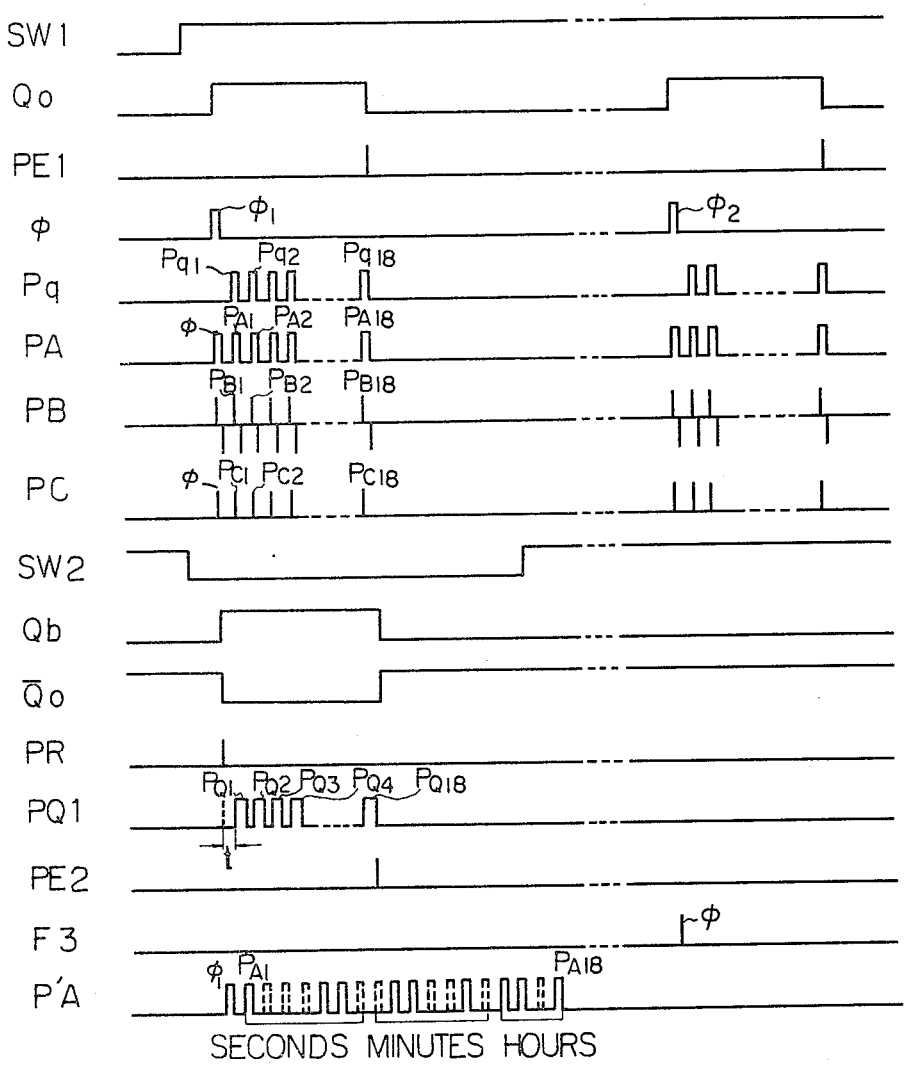
FIG. 8 is a timing chart for illustrating the operations of the first and second electronic timepieces shown in FIGS. 6 and 7.

The clock pulses $\phi$ from frequency converter 156 are also applied to a set terminal Sa of an R-S type flip-flop 162, whose Qa output is coupled to a gate G1 of a read-out signal generator circuit 164 to a clock terminal C1 of which is coupled an intermediate stage of the frequency converter 156 to receive the read-out control pulses Pq. A reset terminal Ra of the flip-flop 162 is coupled to a terminal E1 of the read-out signal generator circuit 164. The read-out signal generator circuit 164 is started in synchronism with a first clock pulse $\phi_1$ of the train of clock pulses $\phi$ and generates read-out signals Pq1 through Pq18 at output terminals q1 through q18 in response to the read-out control pulses Pq from the frequency converter 156. These read-out signals are applied to first inputs of AND gates AG1 through AG18 constituting an output selection gate circuit 166 serving as a read-out gate circuit. Second inputs of the AND gates AG1 through AG18 are coupled to outputs 01 through 018 of the timekeeping circuit 158. The outputs of the AND gates AG1 through AG18 are coupled to OR gate OG1, which generates a train of output pulses Pq as shown in FIG. 8. In this manner, outputs of the timekeeping circuit 158 are read out in parallel as a train of output pulses Pq. The output pulses Pq are applied to one input of OR gate OG2, to the other input of which is applied the clock pulses $\phi_1$. Thus, the OR gate OG2 generates a train of output pulses PA which are applied through a correction switch SW1 to an electrode plate 168 serving as a means for transmitting the train of output pulses of the first electronic timepiece 150 as a correct time data.

In FIG. 7, the second electronic timepiece 152 comprises a frequency standard 170 composed of a quartz crystal oscillator to provide a relatively high frequency signal f1 of 32,768 Hz. This relatively high frequency signal is applied to a frequency converter 172 in the form of a frequency divider which divides down the relatively high frequency signal to provide a train of clock pulses $\phi$ at a frequency of 1 Hz as a time unit signal. The time unit signal $\phi$ is applied to a timekeeping circuit 174 composed of a seconds counter 174*a*, a minutes counter 174*b*, and an hours counter 174*c*. Outputs from these counters are applied to a display device 176 for the display of current time data stored in the counters.

The relatively high frequency signal f1 from the frequency standard 170 is also applied to one input of an AND gate AG20, whose another input is coupled to the Qb output of an R-S type flip-flop 178 serving as a memory circuit. The AND gate AG 20 has an output coupled to an input of a second frequency converter 180 which forms part of a correction circuit means 177. The second frequency converter 180 divides down the relatively high frequency signal from the standard 170 to provide a train of writing-in control pulses PQ at the same frequency as that of the read-out control pulses Pq in the first electronic timepiece 150, i.e., at a frequency of 128 Hz. The writing-in control pulses PQ are applied to a clock terminal C2 of a writing-in signal generator circuit 182 whose gate terminal G2 is coupled to a preset terminal PR of the second frequency converter 180 via an inverter 184 and coupled to the Qb output of the flip-flop 178. The flip-flop 178 has its set terminal Sb coupled through a waveform shaping circuit 184 to an electrode plate 186 serving as a detecting means for detecting time data in a binary coded form transmitted from the electrode 168 of the first electronic timepiece 150. The waveform shaping circuit 184 serves to perform waveform shaping of the output pulses detected by the electrode plate 186 to generate a train of output pulses Pc on lead 185. The output pulses Pc are applied to the set terminal Sb of the flip-flop 178 so that the output Qb goes to a high logic level in response to the output pulses Pc and, in this condition, the AND gate AG 20 is opened to cause the second frequency converter 180 to generate a train of writing-in control pulses PQ. Thus, the writing-in signal generator circuit 182 is started in synchronism with the synchronizing signal $\phi$ and generates writing-in pulses PQ1 through PQ18 at output terminals Q1 through Q18 as shown in FIG. 8. The writing-in pulses PQ1 through PQ18 are applied to first inputs of writing-in gates AG21 through AG38, respectively, which constitute an input selection gate or writing-in gate circuit 188. The second inputs of the AND gates AG21 through AG38 are coupled to lead 185 to receive the output pulses Pc. The outputs of the AND gates AG21 through AG38 are coupled in parallel to inputs I1 through I18 of the timekeeping circuit 174.

The writing-in signal generator circuit 182 also generates a single output pulse PE2 at the terminal E2 in synchronism with the falling edge of the output pulse PQ18. The output pulse PE2 is applied to the reset terminal Rb of the flip-flop 178 and a reset terminal Rc of a flip-flop 192 forming part of a reset signal generator 190. The set terminal Sc of the flip-flop 192 is coupled to a reset terminal Re of the time counter circuit 174 and the reset terminal Rd of the frequency converter 172, to which an output of an AND gate AG39 is also coupled. One input of the AND gate AG39 is coupled to the $\overline{Q}$c output of the flip-flop 192 and the other input is coupled to an output of an AND gate AG 40. The AND gate AG 40 has its one input coupled to the frequency standard 170 and the other input coupled to the $\overline{Q}$b output of the flip-flop 178.

With the arrangement mentioned hereinabove, an output signal f1 from the frequency standard 154 is divided down to provide a train of clock pulses $\phi$ and a train of read-out control pulses Pq at frequencies 1 and 128 Hz, respectively. The clock pulses $\phi$ are applied to the timekeeping circuit 158 to drive the same to perform timekeeping function. Outputs from the seconds counter 158*a*, minutes counter 158*b* and hours counter 158*c* are applied to the display device 160 by which the current time data are displayed. Further, the clock pulses $\phi$ are applied to the set terminal Sa of the flip-flop 162 and gated through the OR gate OG 2. Consequently, the flip-flop 162 is set and the output Qa goes to a high logic level. The output Qa is then applied to the gate terminal G1 of the read-out signal generator circuit 164, the operation of which is consequently started. Since, in this instance, the train of readout control pulses Pq are applied to the clock terminal C1 of the read-out signal generator circuit 164, read-out pulses Pq1 through Pq18 appear at the output terminals q1 through q18. These read-out pulses are applied to the first inputs of the AND gates AG1 through AG 18, respectively, to the second inputs of which are also applied in parallel outputs O1 through O18 from the timekeeping circuit 158. Thus, the output OG1 of the output selection gate circuit 166 generates a train of output pulses PA as read-out signals composed of a clock pulse $\phi$1 and remaining pulses PA1 through PA18. The read-out signal generator circuit 164 also generates at terminal E1 an output pulse PE1 as shown in FIG. 8 in synchronism with the falling edge of the read-out pulse Pq18 appearing at the output terminal q18. This output pulse PE1 is applied to the reset terminal Ra of the flip-flop 162, which is consequently reset. In this condition, the Qa output goes to a low logic level and, therefore, the gate terminal G1 of the read-out signal generator circuit 164 is reset and the operation of the signal generator 164 is stopped until the following clock pulse $\phi$2 is applied to the set terminal of the flip-flop 162.

During operation of the read-out signal generator 164, if the output 01 of the timekeeping circuit 158 is at a high logic level, the read-out pulse Pq1 is gated through the AND gate AG1 as an output pulse PA1. The output pulse PA1 is passed through the OR gates OG1 and OG2 to an output terminal A via the correction switch SW1. If, in contrast, the output O1 of the timekeeping circuit 158 is at a low logic level, the AND gate AG1 is inhibited and, therefore, the output pulse PA1 is not delivered to the output terminal A. Similarly, if the output O2 of the timekeeping circuit 158 is at a high logic level when the read-out pulse Pq2 is generated by the read-out signal generator circuit 164, the read-out pulse Pq2 is gated through the AND gate AG2 as an output pulse PA2 which is delivered to the output terminal A. On the contrary if the output 02 is at a low logic level, the output pulse PA2 is not delivered to the output terminal A. In this manner, the content of each of the counters 158*a*, 158*b* and 158*c* is detected in parallel by the output selection gate circuit 166 and represented by a train of output pulses PA as shown in FIG. 8. The waveform P'A in FIG. 8 shows that the timekeeping circuit 158 has a current time of 11:26 and 31 seconds, by way of example. It should be understood that the read-out operation will be repeated cyclically in synchronism with the clock pulses $\phi$ and the read-out data are transmitted from the electrode 168 to the outside when the correction switch SW1 is closed.

The synchronizing pulse $\phi$1 in the output pulses PA are detected by the electrode plate 186 of the second electronic timepiece 152 when the second electronic timepiece is placed adjacent the electrode plate 168 of the first electronic timepiece 150. If in this case, the electrode 186 comprises a capacitor, then a train of differentiation pulses PB appear at terminal B of the second electronic timepiece 152. These differentiation pulses PB are applied to the waveform shaping circuit 184, which generates at terminal C output pulses Pc as shown in FIG. 8.

In normal operation of the second electronic timepiece 152, the output frequency of the frequency standard 170 is divided down by the frequency converter 172 to a low frequency signal of 1 Hz as a time unit signal. This signal drives the timekeeping circuit 174 such that it generates a seconds output, minutes output and hours output. These outputs are applied to the display device 176 and the current time is displayed. Under these circumstances, the flip-flops 178 and 192 are reset while the second frequency converter 180 is preset to a predetermined value. At the same time, the writing-in signal generator circuit 182 remains in its inoperative condition and, therefore, all of the AND gates of the input selection gate circuit 188 are inhibited. If, in this condition, the switch SW2 is closed as shown in FIG. 8, the train of pulses Pc are applied to the input selection gate circuit 188. Since, at this instance, the all of the AND gates AG21 through AG38 are inhibited, the input selection gate circuit 188 does not generate any output signal. The train of pulse Pc are also applied to the set terminal Sb of the flip-flop 178. Application of the synchronizing pulse $\phi$1 to the set terminal Sb causes the flip-flop 178 to be set so that the Qb output goes to a high logic level as shown in FIG. 8. The Qb output is applied to the AND gates AG 20 and AG40, which are consequently opened. At the same time, the preset terminal PR of the second frequency converter 180 is released by the action of the inverter 184 and the gate terminal G2 of the writing-in signal generator circuit 182 is set. Since, in this condition, the flip-flop 192 of the reset signal generator circuit 23 remains in its reset condition, the Qc output is at a high level, opening the AND gate AG 39. As previously noted, the flip-flop 178 is set in response to the synchronizing signal $\phi$1 and the Qb output goes to a high level. This causes the AND gate AG40 to open, thereby gating the output signal f1 from the frequency standard 170 to the input of the AND gate 39. The output signal is then gated through the AND gate AG39 to the reset terminal Rd of the frequency converter 172 and the reset terminal Re of the timekeeping circuit 174. Thus, the frequency converter 172 and the timekeeping circuit 174 are rendered inoperative. Since, at the same time, the output of the AND gate 39 is applied to the set terminal Sc of the flip-flop 192, the Qc output of the flip-flop 192 goes to a low logic level so that the AND gate AG39 is inhibited. In this manner, the reset signal generator 190 is started in synchronism with the synchronizing signal $\phi$1 to generate a reset signal PR as shown in FIG. 8, and the frequency converter 172 and the time counter circuit 174 of the second electronic timepiece 152 are instantaneously reset.

On the other hand, the output signal from the frequency standard 170 is applied to the frequency converter 180 via the AND gate AG20 and frequency divided to generate a train of writing-in control pulses PQ as shown in FIG. 8. These control pulses are applied to the clock signal terminal C2 of the writing-in signal generator circuit 182, which consequently generates writing-in pulses PQ1 through PQ18 at the output terminals Q1 through Q18. As previously mentioned, the writing-in pulses PQ has the same frequency as that of the read-out pulses Pq and delayed in phase by a prescribed time interval t equal to the preset value of the second frequency converter 180, as shown in FIG. 8. This delay time interval t is provided for bringing the time information signal Pc into coincidence in phase with the writing-in pulses PQ. Consequently, when an output pulse PQ1 appears at the output terminal Q1 of the signal generator circuit 182, the AND gate AG21 is opened. If, in this instance, the output pulse Pc1 appears at the terminal C, this pulse is gated through the AND gate AG21 and input to the input I1 of the time counter circuit 174. If, in contrast, the output pulse Pc1 does not appear at the terminal C, then no pulse is applied to the input I1 of the timekeeping circuit 174. When, further, an output pulse PQ2 appears at the output terminal Q2 of the signal generator circuit, the AND gate AG22 of the input selection gate circuit 188 is opened. Consequently, the output pulse Pc3 is written into the input I3 of the timekeeping circuit 174. In this manner, when the writing-in of the output pulse Pc18 is completed in response to the writing-in signal PQ18, the current time data written into the timekeeping circuit 174 of the second electronic timepiece 152 become equal to that of the first electronic timepiece 150. The signal generator circuit 182 generates an output pulse PE2 at the terminal E2 in synchronism with the falling edge of the output pulse PQ18 as shown in FIG. 8, by which the flip-flops 178 and 192 are reset. Thus, a time correction of the secon electronic timepiece 152 is completed. The frequency converter 172 generates a time unit signal $\phi$ as shown by the waveform F3 in FIG. 8 after one second when the frequency converter 172 is reset in response to the synchronizing pulse $\phi$1.

As shown in FIG. 8, when the switch SW2 is open, the time correction will be repeated every one synchronizing pulse $\phi$ (having a period of one second). Accordingly, it is preferable to close the switch SW2 to connect the terminal B to the ground so that the detected signals are not applied to the terminal C whereby the time correcting operation will be stopped.

While, in the illustrated embodiments, the present invention has been shown and described as having electrodes as a coupling means to transfer the synchronizing signal and the timekeeping signal from the first electronic timepiece to the second electronic timepiece, it should be noted that the coupling means may be constituted by coils, mechanical contacts, photo-sensors, optical devices, etc. Further, it should be understood that the correction switch of the second electronic timepiece may comprise a magnetic switch adapted to be operated by a magnet from outside, and, in this case, an external switch may be dispensed with.

It will now be appreciated from the foregoing description that in accordance with the present invention time correction for a second electronic timepiece can be quickly performed in an automatic fashion merely by coupling the second electronic timepiece to a first electronic timepiece in such a suitable means as already mentioned. Thus, it is easy to correct the current time data in the second electronic timepiece in a more precise manner than in the prior art method. Another advantage resides in the fact that an excessive number of external control switches can be reduced by a simplified method of time correction.

What is claimed is:

1. An electronic timepiece having detecting means adapted to receive correction pulses transmitted as current time data from a standard timepiece, comprising:

a frequency standard providing a relatively high frequency signal;

a frequency converter responsive to said relatively high frequency signal for providing a relatively low frequency signal, timing signals and a train of clock pulses;

a timekeeping circuit including a first shift register, a second shift register, and a serial adder circuit connected in series to constitute a shift register ring in which timekeeping data are cyclically shifted in response to said timing signals;

correction switch means normally held in a non-correction state and selectively operable to assume a correction state to provide an input signal;

means for generating a control pulse in response to said input signal;

means for generating a control signal in response to said control pulse;

inhibiting gate means normally opened in the absence of said control signal to effect shifting of said timekeeping data in said shift register ring and inhibited in the presence of said control signal;

writing-in gate means coupled to said shift register ring;

control gate means connected to said detecting means and adapted to be opened in response to said control signal to pass said correction pulses therethrough;

said writing-in gate means being responsive to said correction pulses to correct said time-keeping data to coincide with said current time data;

a driver circuit responsive to said timekeeping data to provide drive signals; and display means for providing a display of said current time data in response to said drive signals.

2. An electronic timepiece according to claim 1 further comprising storage means for temporarily storing said correction pulses which are written into said shift register ring via said writing-in gate means in a sequential fashion in response to said timing signals to effect automatic correction of said timekeeping data.

3. An electronic timepiece according to claim 1, in which said control pulse generating means comprises an R-S type flip-flop having a set terminal coupled to said correction switch means, a reset terminal, first output coupled to said control gate means, and a second output, and further comprising gate means responsive to a final one of said timing pulses to generate an output signal, said R-S type flip-flop being reset in response to said output signal whereby said control gate means is inhibited to prevent the transfer of said correction pulses therethrough and to open said inhibiting gate means, to cause said shift register ring to start its normal timekeeping operation.

4. An electronic timepiece according to claim 1, in which said correction pulses have a synchronizing pulse and said frequency converter has a reset terminal, and further comprising an OR gate having its first input coupled to said correction switch means and its second input coupled to said detecting means to receive said synchronizing pulse, and an R-S type flip-flop having a set terminal coupled to said control pulse generating means, a reset terminal coupled to an output of said OR gate and an output terminal coupled to the reset terminal of said frequency converter, said R-S type flip-flop being set in response to said control pulse for resetting said frequency converter and reset in response to said synchronizing pulse applied through said OR gate for releasing a reset condition of said frequency converter which consequently begins to operate in synchronism with said synchronizing pulse whereby said shift register ring is actuated in synchronism with said synchronizing pulse.

* * * * *